US011903508B2

(12) United States Patent
Dorsey

(10) Patent No.: US 11,903,508 B2
(45) Date of Patent: Feb. 20, 2024

(54) WRINKLE PILLOW

(71) Applicant: Sylvia Longoria Dorsey, Houston, TX (US)

(72) Inventor: Sylvia Longoria Dorsey, Houston, TX (US)

( * ) Notice: Subject to any disclaimer, the term of this patent is extended or adjusted under 35 U.S.C. 154(b) by 0 days.

(21) Appl. No.: 17/958,739

(22) Filed: Oct. 3, 2022

(65) Prior Publication Data

US 2023/0022848 A1 Jan. 26, 2023

Related U.S. Application Data

(63) Continuation of application No. 16/878,169, filed on May 19, 2020, now Pat. No. 11,622,640.

(51) Int. Cl.
*A47G 9/10* (2006.01)

(52) U.S. Cl.
CPC ..... *A47G 9/10* (2013.01); *A47G 2009/1018* (2013.01)

(58) Field of Classification Search
CPC ... A47G 9/10; A47G 2009/1018; A47C 7/021
See application file for complete search history.

(56) References Cited

U.S. PATENT DOCUMENTS

| | | | | |
|---|---|---|---|---|
| 3,222,694 | A | 12/1965 | Schick | |
| D314,116 | S | 1/1991 | Reed | |
| 5,083,555 | A | 1/1992 | Lewis | |
| 5,807,160 | A | 9/1998 | Wehmeyer | |
| D417,997 | S | 12/1999 | Yannakis | |
| 6,012,188 | A | 1/2000 | Daniels et al. | |
| 6,769,955 | B1 | 8/2004 | Fisher | |
| 6,810,541 | B1 | 11/2004 | Woods | |
| 6,929,325 | B1 | 8/2005 | Goelo | |
| 7,001,239 | B2 | 2/2006 | Russell | |
| 7,144,295 | B2 | 6/2006 | Fisher | |
| D595,986 | S | 7/2009 | Kloes et al. | |
| 8,047,892 | B1 | 11/2011 | Dempsey | |
| 8,317,569 | B2 | 11/2012 | Fisher-Pacheco | |
| 11,622,640 | B2 * | 4/2023 | Dorsey | A47C 20/02 5/636 |
| 2013/0036553 | A1 | 2/2013 | Mann Kass | |
| 2015/0108802 | A1 | 4/2015 | Krishtul | |
| 2017/0099953 | A1 | 4/2017 | Harte | |
| 2017/0099967 | A1 | 4/2017 | Holbrook et al. | |
| 2017/0253677 | A1 | 9/2017 | Erten | |
| 2017/0340126 | A1 | 11/2017 | Carline | |
| 2020/0069063 | A1 | 3/2020 | Bates | |

OTHER PUBLICATIONS

USPTO Notice of Allowance for U.S. Appl. No. 16/878,169 dated Aug. 24, 2022.
USPTO Non-Final Office Action for U.S. Appl. No. 16/878,169 dated Jul. 1, 2022.
USPTO Final Office Action for U.S. Appl. No. 16/878,169 dated Mar. 16, 2022.
USPTO Non-Final Office Action for U.S. Appl. No. 16/878,169 dated Sep. 8, 2021.

* cited by examiner

*Primary Examiner* — Eric J Kurilla
(74) *Attorney, Agent, or Firm* — Tumey L.L.P.

(57) ABSTRACT

A wrinkle pillow, comprising two lobes each comprising a top, a bottom, and a side; a tapered indentation joining the two lobes, wherein the two lobes and the tapered indentation form an exterior comprising an hourglass shape, and further wherein the tapered indentation comprising a top, a bottom, and a side; and a filling.

5 Claims, 5 Drawing Sheets

WRINKLE PILLOW

STATEMENT REGARDING FEDERALLY SPONSORED RESEARCH OR DEVELOPMENT

Not applicable.

CROSS-REFERENCE TO RELATED APPLICATIONS

This application claims priority to U.S. patent application Ser. No. 16/878,169 filed May 19, 2020, the entire disclosure of which is incorporated herein by reference.

BACKGROUND

1. Field of Disclosure

The field of this application and any resulting patent relates to pillows. More specifically, the present application is directed to pillows for preventing and/or minimizing wrinkles in the cleavage and décolletage areas of a person.

2. Description of Related Art

Generally, many women have issues with wrinkling or creping of the skin between their breasts—the cleavage and décolletage areas. In most instances, this wrinkling or creping may be caused by the woman laying down on one side or the other, wherein the weight of the woman's breasts may cause such wrinkling or creping.

Various products and methods have been proposed and utilized for preventing and/or minimizing wrinkles in the cleavage and décolletage areas, including some of the products and methods disclosed in the references appearing on the face of this patent. However, those products and methods lack all the steps or features of the products and methods covered by any patent claims below. As will be apparent to a person of ordinary skill in the art, any products and methods covered by claims of the issued patent solve many of the problems that prior art products and methods have failed to solve. Also, the products and methods covered by at least some of the claims of this patent have benefits that could be surprising and unexpected to a person of ordinary skill in the art based on the prior art existing at the time of invention.

SUMMARY

One or more specific embodiments disclosed herein includes a wrinkle pillow, comprising two lobes each comprising a top, a bottom, and a side; a tapered indentation joining the two lobes, wherein the two lobes and the tapered indentation form an exterior comprising an hourglass shape, and further wherein the tapered indentation comprising a top, a bottom, and a side; and a filling.

DETAILED DESCRIPTION

1. Introduction

Figure 1:
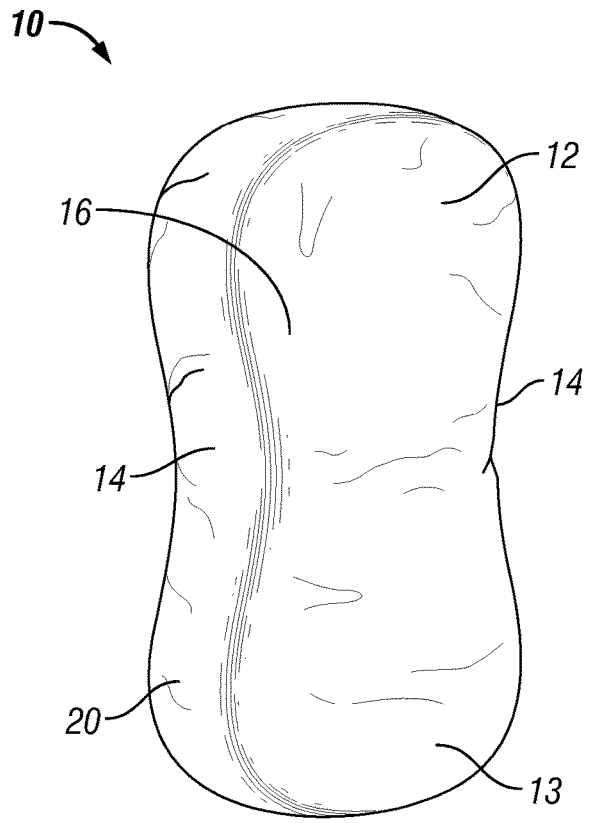
FIG. 1 illustrates a perspective view of an embodiment of a wrinkle pillow.

A detailed description will now be provided. The purpose of this detailed description, which includes the drawings, is to satisfy the statutory requirements of 35 U.S.C. § 112. For example, the detailed description includes a description of the inventions defined by the claims and sufficient information that would enable a person having ordinary skill in the art to make and use the inventions. In the figures, like elements are generally indicated by like reference numerals regardless of the view or figure in which the elements appear. The figures are intended to assist the description and to provide a visual representation of certain aspects of the subject matter described herein. The figures are not all necessarily drawn to scale, nor do they show all the structural details of the systems, nor do they limit the scope of the claims.

Each of the appended claims defines a separate invention which, for infringement purposes, is recognized as including equivalents of the various elements or limitations specified in the claims. Depending on the context, all references below to the "invention" may in some cases refer to certain specific embodiments only. In other cases, it will be recognized that references to the "invention" will refer to the subject matter recited in one or more, but not necessarily all, of the claims. Each of the inventions will now be described in greater detail below, including specific embodiments, versions, and examples, but the inventions are not limited to these specific embodiments, versions, or examples, which are included to enable a person having ordinary skill in the art to make and use the inventions when the information in this patent is combined with available information and technology. Various terms as used herein may be defined below, and any such definitions should be adopted when construing the claims that include those terms, except to the extent a different meaning is given within the specification or in express representations to the Patent and Trademark Office (PTO). To the extent a term used in a claim is not defined below or in representations to the PTO, it should be given the broadest definition persons having skill in the art have given that term as reflected in any printed publication, dictionary, or issued patent.

2. Certain Specific Embodiments

Now, certain specific embodiments are described, which are by no means an exclusive description of the inventions. Other specific embodiments, including those referenced in the drawings, are encompassed by this application and any patent that issues therefrom.

One or more specific embodiments disclosed herein includes a wrinkle pillow, comprising two lobes each comprising a top, a bottom, and a side; a tapered indentation joining the two lobes, wherein the two lobes and the tapered indentation form an exterior comprising an hourglass shape, and further wherein the tapered indentation comprising a top, a bottom, and a side; and a filling.

In any one of the pillows disclosed herein, the exterior may comprise cotton.

In any one of the pillows disclosed herein, the filling may comprise polyester fill.

In any one of the pillows disclosed herein, the longitudinal length of the pillow may be about 19 inches long.

In any one of the pillows disclosed herein, the two lobes may have the same dimensions.

In any one of the pillows disclosed herein, the pillow may further comprise a sham, wherein the sham may comprise Italian sateen cotton.

In any one of the pillows disclosed herein, the pillow may comprise a medium loft.

3. Specific Embodiments in the Figures

The drawings presented herein are for illustrative purposes only and are not intended to limit the scope of the claims. Rather, the drawings are intended to help enable one having ordinary skill in the art to make and use the claimed inventions.

Referring to FIGS. 1-7, a specific embodiment, e.g., version or example, of a wrinkle pillow is illustrated. These figures may show features which may be found in various specific embodiments, including the embodiments shown in this specification and those not shown.

FIG. 1 shows an embodiment of a wrinkle pillow 10. In embodiments, the pillow 10 may comprise a generally hourglass shape. For example, the pillow 10 may comprise lobes 12 and 13 and one or more tapered indentations 14 that may connect the lobes 12 and 13. In embodiments, the pillow 10 may also comprise a top 16 and a bottom 18 (not illustrated), as well as a side 20. Further, in embodiments, the pillow 10 may have a total longitudinal length from one end of lobe 12 to one end of lobe 13 of about 19 inches. Alternatively, in embodiments the total longitudinal length from one end of lobe 12 to one end of lobe 13 may be anywhere within the range of about 15 inches to about 25 inches. In embodiments, the pillow 10 may have a thickness of about 6 inches. Alternatively, in embodiments the thickness of the pillow 10 may be anywhere within the range of about 4 inches to about 8 inches. Additionally, the pillow 10 may be generally symmetrical if folded either longitudinally or laterally.

In the embodiment illustrated in FIG. 1, the exterior of the pillow 10 may comprise cotton. In embodiments, the exterior of the pillow 10 may comprise natural or synthetic materials. In addition to cotton, possible alternatives include, but are not limited to, linen, bamboo, wool, etc. Further, in embodiments, the exterior of pillow 10 may comprise seams where the top 16 meets the side 20 as well as where the bottom 18 meets the side 20. Alternatively, in embodiments buttons, zippers, or other sealing measures may be employed instead of seams.

Figure 2:
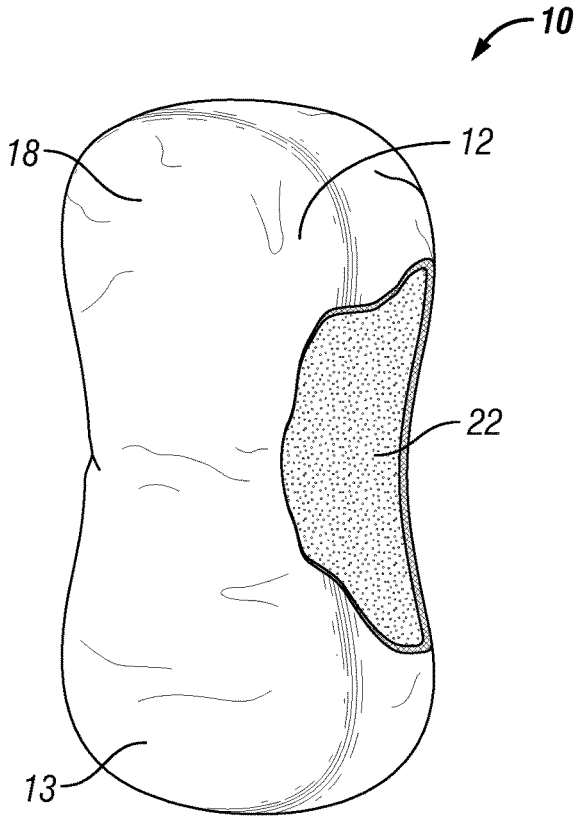
FIG. 2 illustrates a bottom perspective view of the embodiment of the wrinkle pillow shown in FIG. 1, also showing internal filling.

FIG. 2 illustrates a bottom perspective view of an embodiment of the pillow 10 showing the bottom 18 as well as internal filling 22 of the pillow 10. In embodiments, the filling 22 may comprise polyester fill, which may also be referred to as alternative down. Alternatively, the filling 22 may comprise allergen-free materials, hypoallergenic materials, down (duck or goose), foam (including, but not limited to, non-polyurethane foam alternatives and soy-based foam), feathers, microfiber, silk, foam-like materials, recycled materials (including, but not limited to, polyester, cotton, and wool), memory foam, shredded memory foam, buckwheat, hemp, Tencel, organic cotton, latex (natural, synthetic, or a mixture of both), kapok, polyester fiberfill, slick fiberfill (e.g., silicon-coated material), dry fiberfill (e.g., garneted material), microbead, gel, or any combination of the above. Further, in embodiments, the pillow 10 may vary in loft or firmness—low loft (soft), medium loft, and high loft (firm). In embodiments, the amount of the filling 22 employed for an embodiment of the pillow 10 may depend on type of filling 22 used as well as the desired loft.

Figure 3:
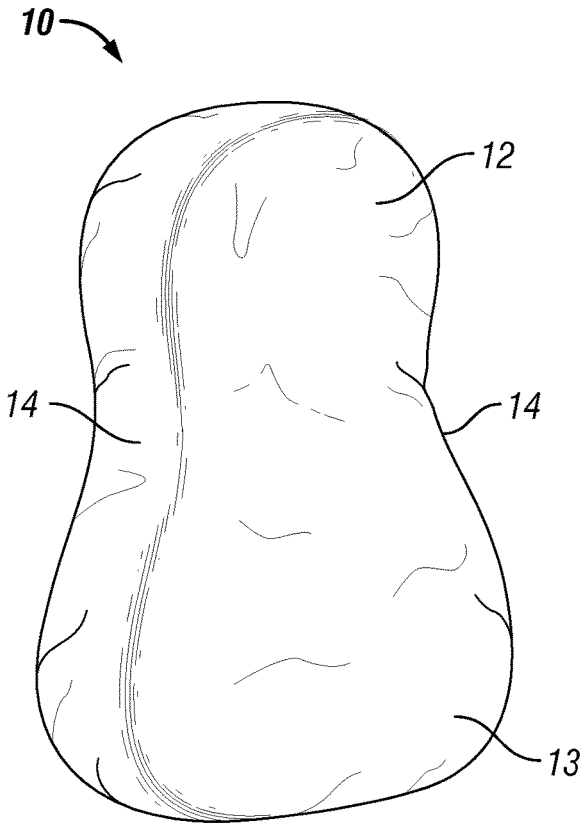
FIG. 3 illustrates a perspective view of an alternative embodiment of a wrinkle pillow comprising two lobes, wherein one lobe is larger than the other lobe.
Figure 4:
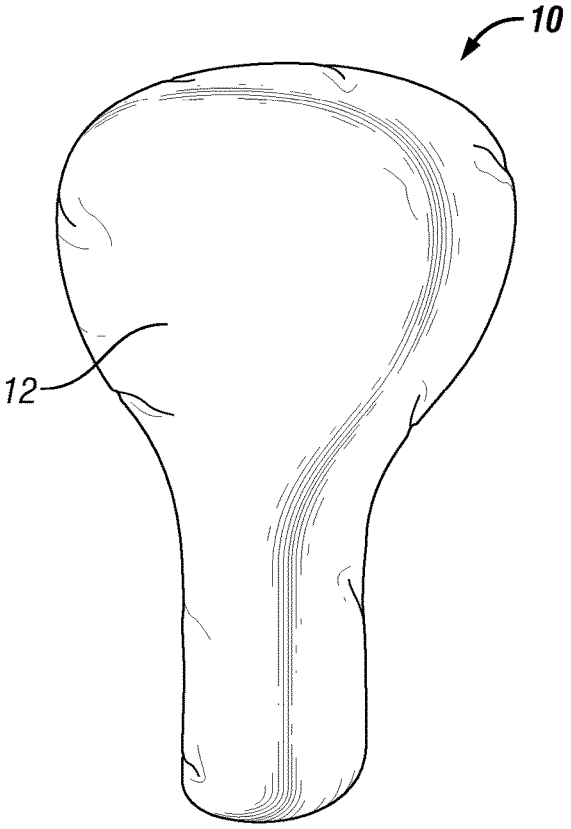
FIG. 4 illustrates a perspective view of an alternative embodiment of a wrinkle pillow comprising a single lobe.

As shown in FIGS. 1 and 2, in embodiments the pillow 10 may comprise the lobes 12 and 13. In embodiments, each of the lobes 12 and 13 may have the same, or about the same, dimensions. For example, in embodiments, each of the lobes 12 and 13 may have a lateral length of about 10 inches at its widest point. Alternatively, in embodiments the lateral length of each lobe 12 and 13 may be anywhere within the range of about 7 inches to about 16 inches. Further, as shown in FIG. 3, in embodiments the size of each of the lobes 12 and 13 may differ from each other. Additionally, as shown in FIG. 4, some embodiments may comprise a single lobe or more than two lobes (not illustrated).

Figure 5:
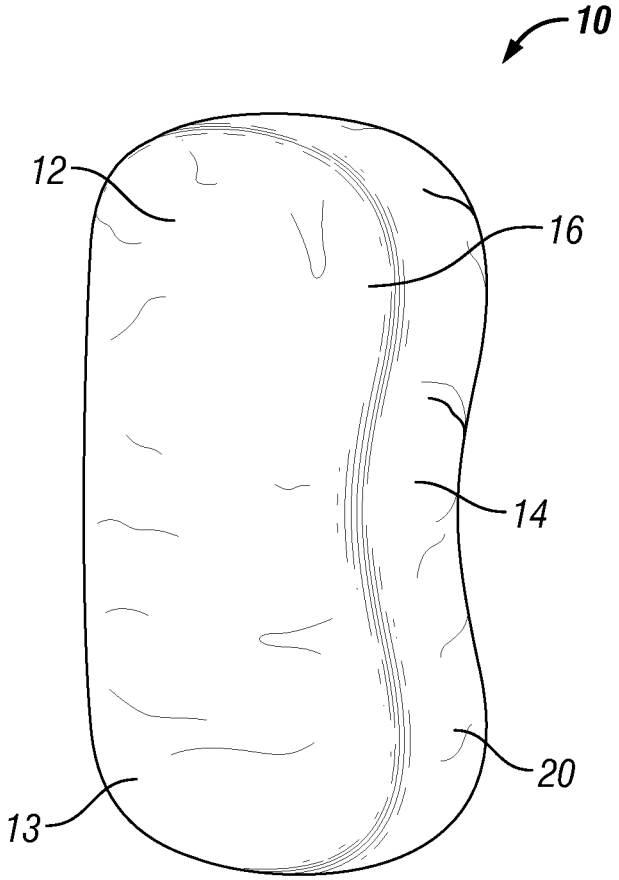
FIG. 5 illustrates a perspective view of an alternative embodiment of a wrinkle pillow comprising a single indentation.

Also, referring to FIG. 1, in embodiments the tapered indentations 14 may have a lateral length of about 8.5 inches at the narrowest point of the tapered indentations 14. Alternatively, in embodiments the total lateral length at the narrowest point of the tapered indentations 14 may be anywhere within the range of about 7 inches to about 14 inches. Additionally, the slope or curvature of the tapered indentations 14 may vary as well. Further, alternative embodiments of pillow 10 may comprise only one tapered indentation 14, as shown in FIG. 5.

Figure 6A:
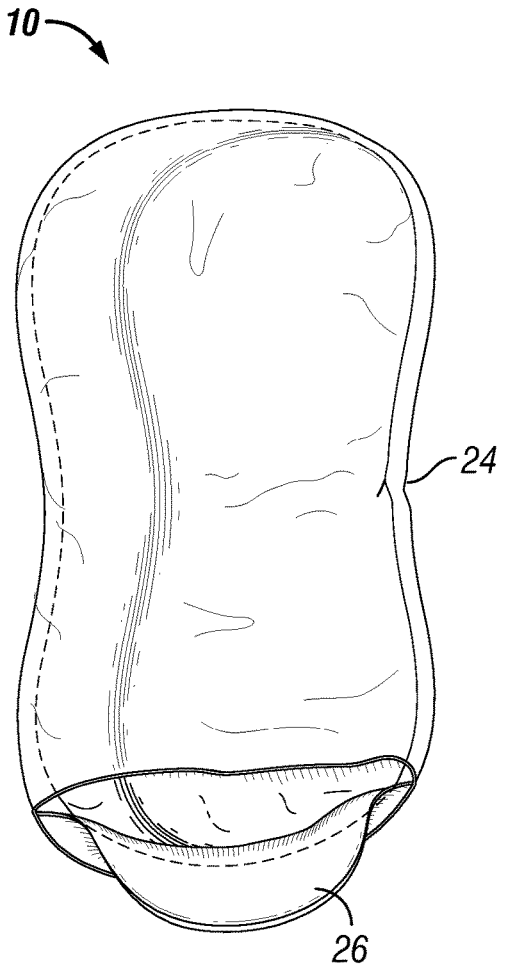
FIG. 6A illustrates a perspective view of the wrinkle pillow embodiment in FIG. 1 with a sham covering the wrinkle pillow.
Figure 6B:
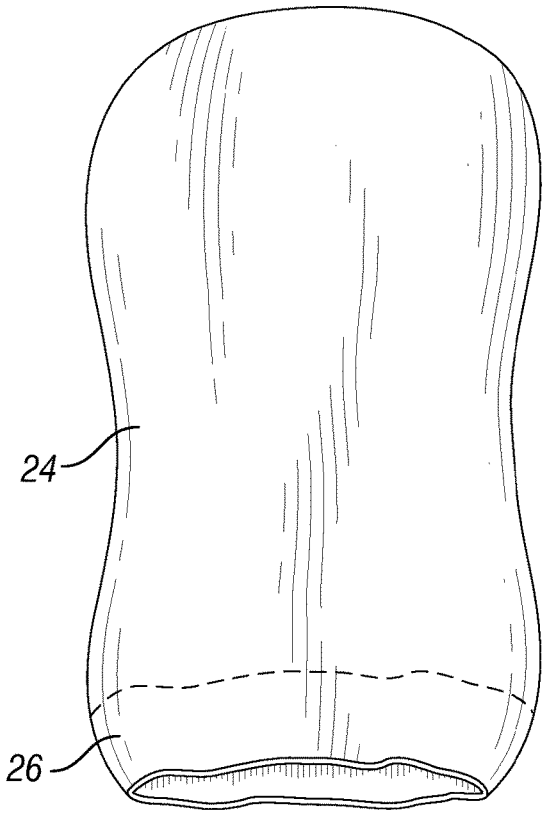
FIG. 6B illustrates a perspective view of a sham.

FIG. 6A illustrates the embodiment of FIG. 1 with a sham 24 on pillow 10. FIG. 6B illustrates an embodiment of the sham 24 separate from the pillow 10. In embodiments, the sham 24 may comprise an envelope end 26. Alternatively, in embodiments the envelope end 26 may comprise buttons, Velcro, or a zipper. Further, in embodiments, the sham 24 may comprise Italian sateen cotton. Alternatively, the sham 24 may comprise silk charmeuse, satin, silk, cotton, linen, wool, or a synthetic material. Additionally, in embodiments the sham 24 may be machine-washable.

Figure 7:
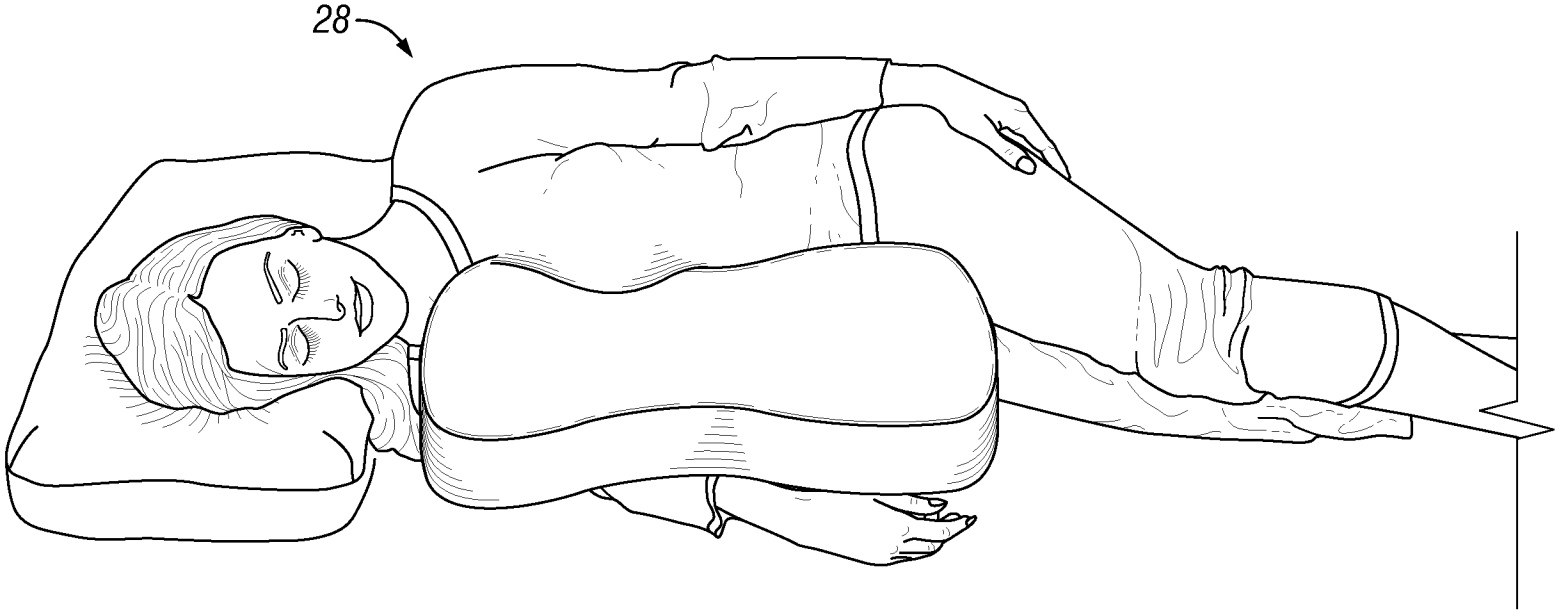
FIG. 7 illustrates a perspective view of the wrinkle pillow embodiment in FIG. 1 as well as a user of the wrinkle pillow.

In embodiments, use of the pillow 10 may include the following steps. In some situations, a user 28, as illustrated in FIG. 7, may position the pillow 10 so that the longitudinal axis of the pillow 10 is parallel to the longitudinal axis of the user 28. Further, the pillow 10 may be positioned so that the side 20 of the pillow 10 may directly contact the body of user 28 as illustrated in FIG. 7. In embodiments, the user 28 may orient the pillow 10 in such a way that the lobe 12 may positioned between the breasts of the user 28 and in such a way that the tapered indentation 14 may be positioned adjacent to the center of the breastbone where the ribs of user 28 come together. Thus, in embodiments, the pillow 10 positioned in this way may prevent, and/or minimize, the presence of wrinkles in the chest, or décolletage, area of the user 28.

Generally, many women have issues with wrinkling or creping of the skin between their breasts—the chest and décolletage areas. In most instances, this wrinkling or creping may be caused by the woman sleeping on one side or the other, wherein the weight of the woman's breasts may cause such wrinkling or creping. The above describes an improved product and method for preventing, and/or minimizing, the presence of wrinkles in the cleavage and décolletage areas of the user 28.

The invention claimed is:

1. A method of using a wrinkle pillow, comprising:

providing a wrinkle pillow comprising:

two lobes each comprising a top, a bottom, and a side, two tapered indentations joining the two lobes, wherein the two lobes and the two tapered indentations form an exterior comprising an hourglass shape, and further wherein the two tapered indentations comprise a top, a bottom, and sides, an exterior, wherein the exterior comprises cotton, a filling, wherein the filling comprises air-permeable material, wherein the sides of the two lobes and the sides of the tapered indentations comprise a height of between about 4 inches and about 8 inches, wherein the longitudinal length of the pillow is between about 15 inches and about 19 inches, and the horizontal length at the narrowest point of the two tapered indentations is between about 7 inches to about 14 inches;

positioning the wrinkle pillow, wherein the longitudinal axis of the wrinkle pillow is parallel to the longitudinal axis of a user, and further wherein the wrinkle pillow is in direct contact with the body of the user; and orienting the wrinkle pillow, wherein one of the lobes of the wrinkle pillow is placed between the breasts of the user, and further wherein one of the tapered indentations is positioned adjacent to the center of the breastbone of the user.

2. The wrinkle pillow of claim 1, wherein the filling comprises polyester fill.

3. The wrinkle pillow of claim 1, wherein the longitudinal length of the wrinkle pillow is about 19 inches.

4. The wrinkle pillow of claim 1, wherein the two lobes have the same dimensions.

5. The wrinkle pillow of claim 1, further comprising a sham, wherein the sham comprises sateen cotton.

* * * * *